US009644932B2

(12) United States Patent
Kapeles et al.

(10) Patent No.: US 9,644,932 B2
(45) Date of Patent: May 9, 2017

(54) FUZE FOR STUN GRENADE

(71) Applicant: Safariland, LLC, Jacksonville, FL (US)

(72) Inventors: John A. Kapeles, Casper, WY (US); John A. Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 14/876,464

(22) Filed: Oct. 6, 2015

(65) Prior Publication Data

US 2016/0161234 A1 Jun. 9, 2016

Related U.S. Application Data

(63) Continuation of application No. 13/860,904, filed on Apr. 11, 2013, now Pat. No. 9,151,584, which is a continuation of application No. 12/720,208, filed on Mar. 9, 2010, now abandoned.

(60) Provisional application No. 61/158,673, filed on Mar. 9, 2009.

(51) Int. Cl.

| | |
|---|---|
| ***F42C 19/02*** | (2006.01) |
| ***F42C 14/02*** | (2006.01) |
| ***F42B 12/36*** | (2006.01) |
| ***F42B 8/26*** | (2006.01) |
| ***F42B 12/46*** | (2006.01) |
| ***F42B 27/00*** | (2006.01) |
| ***F42B 12/42*** | (2006.01) |
| ***F42C 9/10*** | (2006.01) |
| ***F41H 9/00*** | (2006.01) |

(52) U.S. Cl.

CPC ..... *F42C 19/02* (2013.01); *F41H 9/00* (2013.01); *F42B 8/26* (2013.01); *F42B 12/36* (2013.01); *F42B 12/42* (2013.01); *F42B 12/46* (2013.01); *F42B 27/00* (2013.01); *F42C 9/10* (2013.01); *F42C 14/02* (2013.01)

(58) Field of Classification Search

CPC .. F42B 8/26; F42B 12/36; F42B 12/42; F42B 12/46; F42B 27/00; F42C 14/02; F42C 9/10; F42C 19/02; F41H 9/00

USPC ..... 102/367, 368, 482, 487

See application file for complete search history.

(56) References Cited

U.S. PATENT DOCUMENTS

| | | | | | |
|---|---|---|---|---|---|
| 1,620,475 | A | * | 3/1927 | Lawrence | F42B 12/20 102/368 |
| RE18,938 | E | * | 9/1933 | Conkling | F42B 12/50 102/368 |
| 2,094,562 | A | * | 9/1937 | Lowy | F42B 12/20 102/368 |
| 3,599,571 | A | * | 8/1971 | Richardson | F42B 12/50 102/367 |

(Continued)

FOREIGN PATENT DOCUMENTS

| | | | | |
|---|---|---|---|---|
| WO | WO 9408200 | A1 * | 4/1994 | F42B 4/16 |

*Primary Examiner* — James S Bergin

(74) *Attorney, Agent, or Firm* — Kane Kessler, P.C.; Paul E. Szabo

(57) ABSTRACT

A stun grenade includes a fuze assembly secured to a housing adjacent gas outlet ports. The fuze assembly includes a fuze body having contact surfaces located in the flow path of the gas from the outlet ports so that gas flowing from the outlet ports impinges on the contact surfaces. The contact surfaces of the fuze body extend at an angle of no more than about 50 degrees to the first direction.

4 Claims, 4 Drawing Sheets

(56) References Cited

U.S. PATENT DOCUMENTS

| | | | | |
|---|---|---|---|---|
| 4,932,328 | A * | 6/1990 | Pinkney | F42B 8/26 102/368 |
| 5,654,523 | A * | 8/1997 | Brunn | F42B 8/26 102/368 |
| 6,595,139 | B1 * | 7/2003 | Haeselich | F42B 12/46 102/368 |
| 7,721,651 | B2 * | 5/2010 | Lubbers | F42B 12/36 102/482 |
| 7,963,227 | B1 * | 6/2011 | Brunn | F42B 8/26 102/360 |
| 2008/0276822 | A1 * | 11/2008 | Lubbers | F42B 12/36 102/502 |

* cited by examiner

FUZE FOR STUN GRENADE

RELATED APPLICATIONS

This application claims the benefit of the filing date of U.S. Provisional Application No. 61/158,673, filed Mar. 9, 2009, titled Improved Distraction Device Fuze, the entire disclosure of which is incorporated by reference.

BACKGROUND OF THE INVENTION

Explosive grenades are designed to cause fragmentation of most or all of their parts, including the housing and the fuze body, so as to inflict maximum damage on a person who is nearby when the device explodes.

More recently, a class of grenades have been designed that are variously known as stun grenades, or flash-bang devices. These devices are not intended to cause physical harm, but rather are intended to temporarily stun a person with a loud sound, a bright flash, and a pressure wave. Such devices are intended to be activated near the person and thus must not fragment or they could cause serious harm to the person.

Many of these less lethal devices use carry-over parts from fragmentation grenades, simply replacing the explosive charge with a different charge. One part that has to date been carried over, without change, is the fuze body. For example, U.S. Pat. No. 5,654,523, the entire disclosure of which is hereby incorporated by reference, describes a stun grenade that includes a grenade body having a plurality of vents on one end, adjacent to a fuze body that supports the fuze of the device. The fuze body includes portions that support the release lever of the device. The outlet vents of the grenade body direct some of the byproducts onto the fuze body wings. The force that is transmitted into the fuze body by the explosion byproducts can undesirably cause the fuze head to separate, or the fuze body otherwise to fragment, consequences that could undesirably result in injury to a nearby person. The present invention addresses this problem.

BRIEF DESCRIPTION OF THE DRAWINGS

Features and advantages of the invention will become apparent to one of ordinary skill in the art to which the invention pertains from a reading of the following description together with the attached drawings, in which.

DETAILED DESCRIPTION

Figure 1:
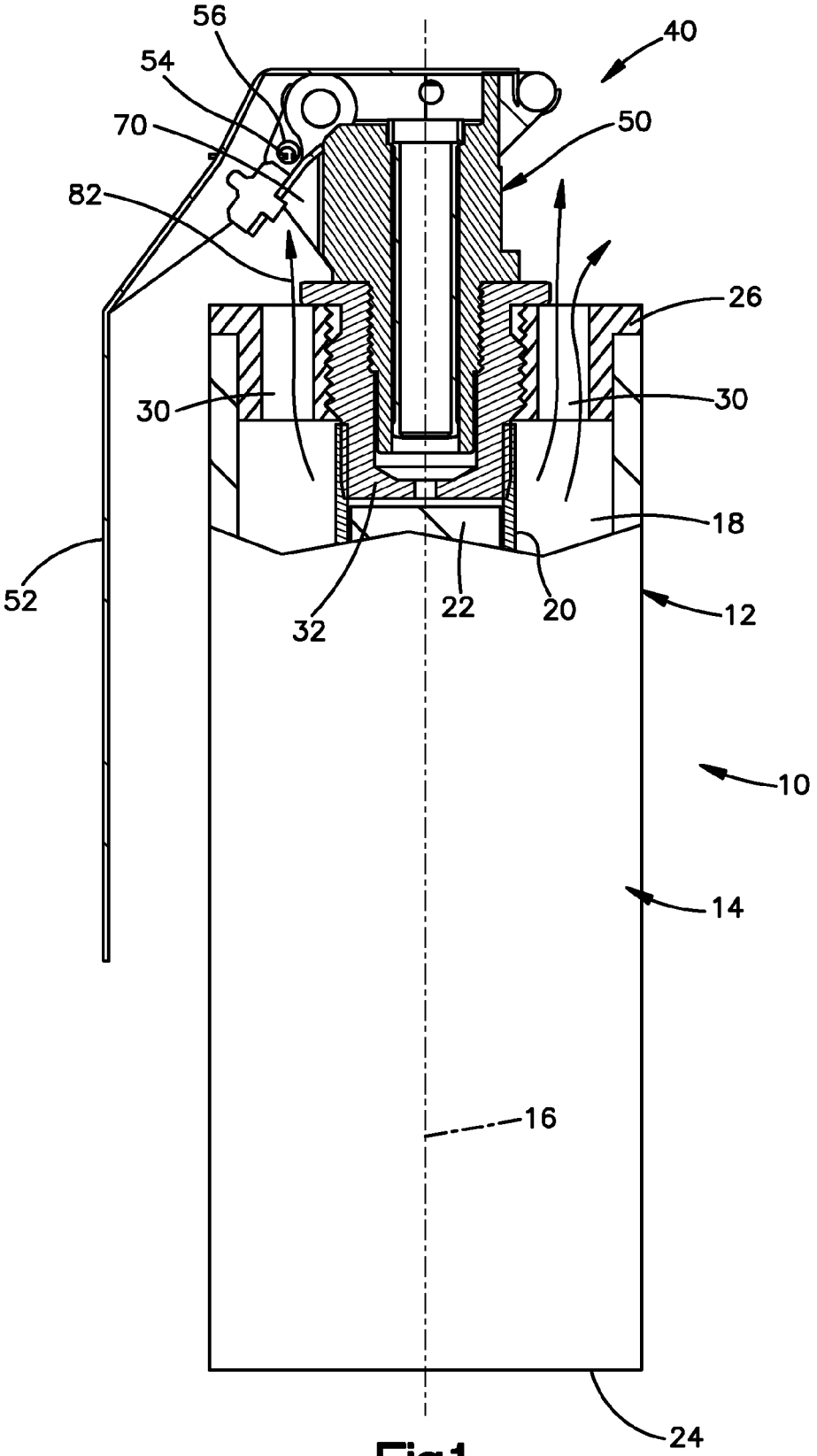
FIG. 1 is a longitudinal sectional view of a stun grenade in accordance with a first embodiment of the invention.
Figure 2:
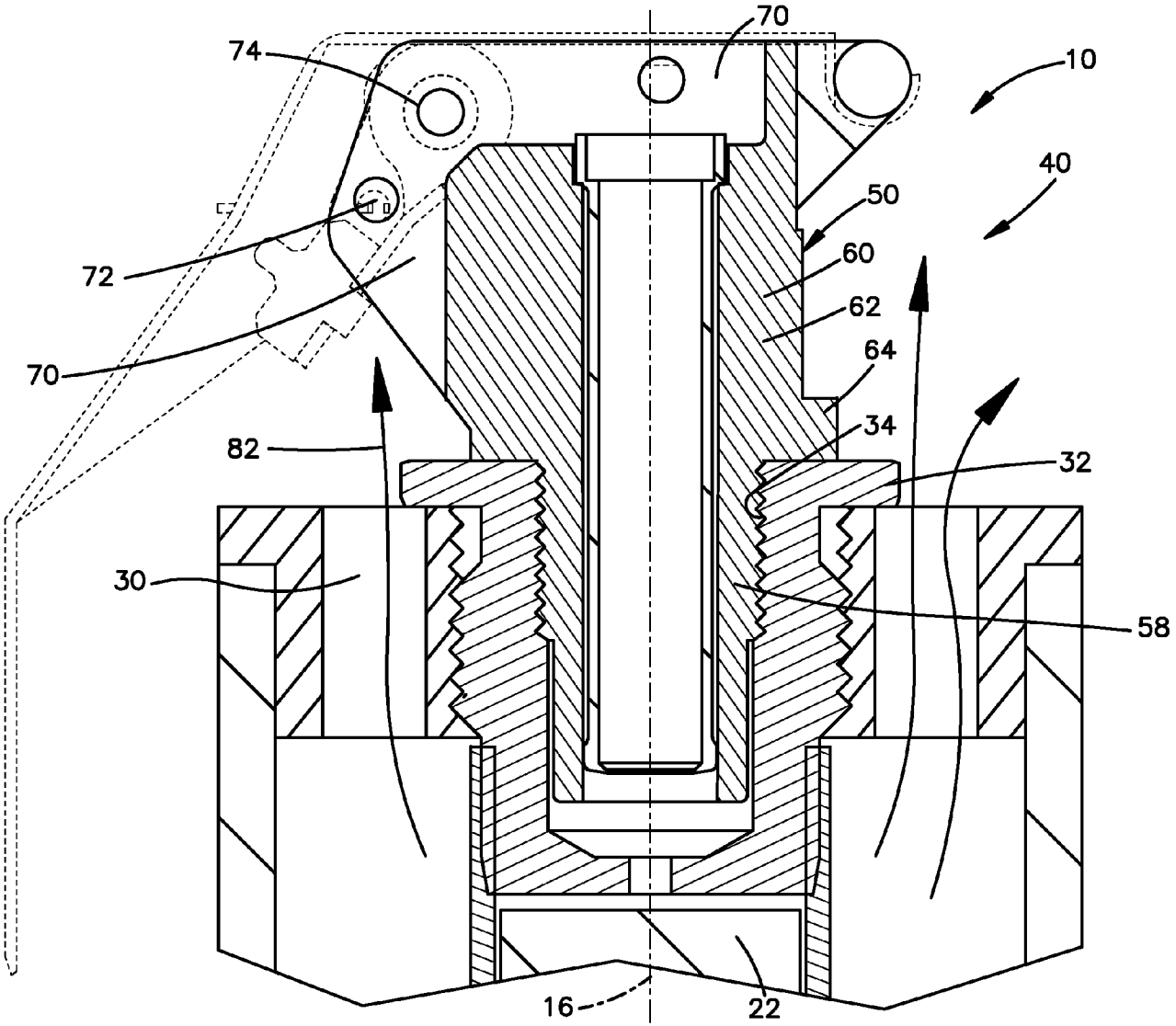
FIG. 2 is an enlarged view of a portion of the device of FIG. 1 illustrating a fuze assembly that is part of the device.

This invention relates to stun grenades, and in particular relates to a stun grenade with a fuze body that is configured to minimize the possibility of separation or fragmentation. The invention is applicable to stun grenades of varying and different configurations. As representative of the invention, FIG. 1 illustrates a stun grenade 10 constructed in accordance with a first embodiment of the invention.

The stun grenade 10 includes a housing 12. The housing 12 includes a main body 14 having a cylindrical configuration centered on a longitudinal central axis 16 of the device 10. The main body 14 defines a cylindrical chamber 18 for receiving a cartridge 20 containing a charge 22 such as an explosive mixture that when activated generates explosion byproducts including gas under pressure as well as a bright flash and a loud bang. A bottom wall 24 closes one end of the chamber 18 and a top wall 26 the other end of the chamber.

The top wall 26 has a plurality of outlet ports 30 communicating with the chamber 18. The outlet ports 30 are disposed in a circular array centered on the axis 16. A collar 32 is screwed into the top wall 26. The collar 32 has a threaded central opening 34.

The stun grenade 10 includes a fuze assembly 40 for activating the charge 22. The fuze assembly 40 is secured to the collar and includes a fuze body 50. The fuze body 50 supports a fuze lever or release lever 52. A pin 54 is received in an opening 56 in the fuze body 50; the pin must be removed before the lever 52 can be released to activate the device 10.

The fuze body 50 is preferably made from cast zinc, but can be made from another material. The fuze body 50 includes an externally threaded, hollow, cylindrical mounting post 58 that screws into the collar 32. The fuze body 50 also includes a fuze head 60, which is the portion of the fuze body that extends axially outward of the collar 32, in a direction away from the mounting post 58. The fuze head 60 includes a centrally located main body portion 62 that is co-axial with the mounting post 58. A radially extending flange 64 is located at the area between the main body portion 62 and the mounting post 58.

The fuze head 60 includes two wings 70 that extend outward from the main body portion 62. The wings 70 are planar in configuration and extend parallel to each other, on opposite sides of the axis 16, in a direction away from the axis. The wings 70 extend parallel to a radius located midway between them. Each wing 70 includes an opening 72 that receives the locking pin 54, which extends between the two wings. Each wing 70 also includes an opening 74 for receiving and supporting the fuze lever 52.

Figure 5:
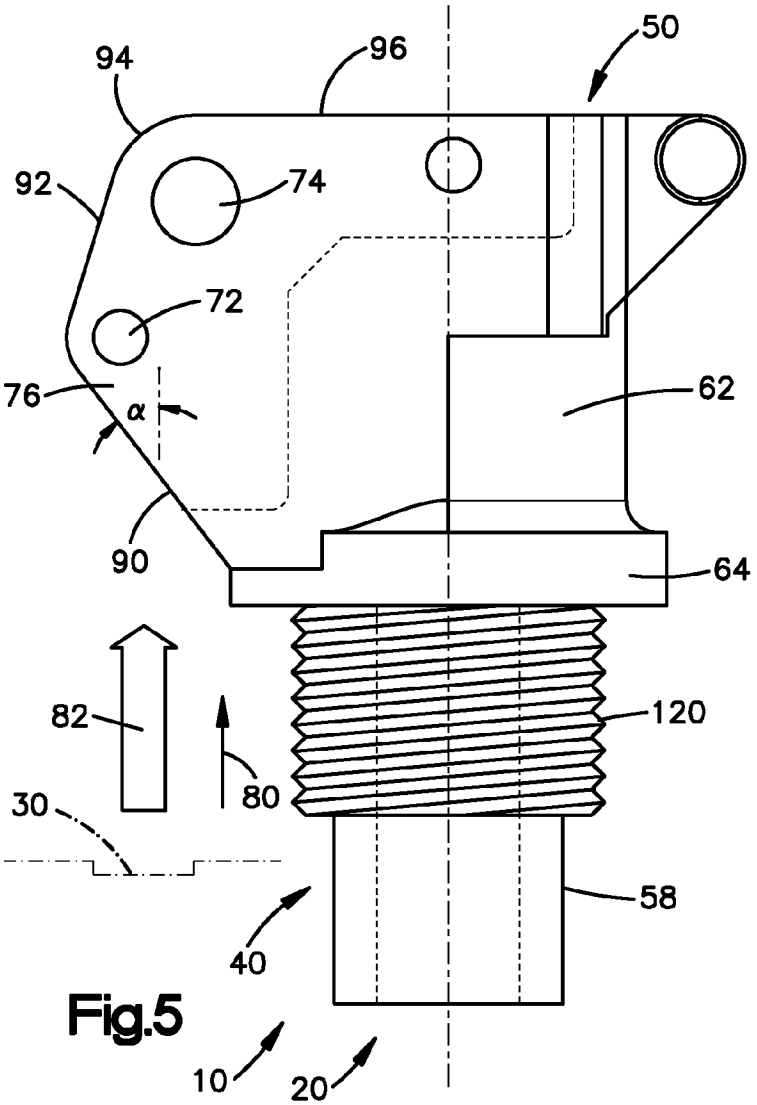
FIG. 5 is an enlarged schematic view of a portion of the fuze body of the stun grenade of FIG. 1.

When viewed in elevation, as in FIG. 5, each wing 70 can be seen to have a generally triangular edge portion 76, or lever support portion, that contains the openings 72 and 74 that support the pin 54 and the lever 52. The edge portion 76 is disposed radially outward of the mounting post 58, and of the main body portion 62, and of the flange 64 of the fuze body 50.

The wings 70 are formed with a relatively thin wall section. For example, in one embodiment, the wings 70 are 0.08 inches in thickness, extend about 0.4 inches radially outward from the main body portion 62, and project about 0.8 inches axially from the flange 64.

When the charge 22 is activated, byproducts including gas under pressure flow from the outlet ports 30, in a flow path 80 that extends in a first direction as indicated by the arrows 82, a direction generally parallel to the axis 16. The wings 70 are the portion of the fuze body 50 that is located axially above the outlet ports 30 of the device 10, in the flow path 80. The wings are relatively far out from the axis 16 of the device 10, and thus have a relatively high moment arm that could impart a significant twisting force on the fuze head 60, tending to cause the fuze head to twist upward and possibly separate from the other parts of the fuze body 50 including the threaded mounting post 58. It is therefore desirable to minimize forces applied to the wings by explosion byproducts flowing from the outlet ports 30.

To this end, the fuze body 50, and specifically the wings 70, is designed with minimal exposure to the force of such byproducts. Specifically, each wing 70 has a first edge surface 90 that extends from the outer edge of the flange 64, axially and radially outward from the flange, to a location just outside of the opening 72 that supports the pin 54. In one embodiment, this first edge surface 90 extends at an angle "α"(FIG. 5) which is most preferably about 31 degrees from the first direction 82. In other embodiments, this angle can be in the range of from 20 degrees to 50 degrees, and is preferably in the range of from 20 degrees to 40 degrees. Because the edge surface 90 lies at a relatively small angle to the first direction 82, its exposure to the force of the gases flowing from the output ports 30 is lessened.

Each wing 70 has a second edge surface 92 that extends from the first edge surface 90, axially outward and radially inward, to a location just outside of the opening 74. This second edge surface 92 merges, via a radius surface 94, with a third or outer edge surface 96 of the wing 70, which extends perpendicular to the axis 16 and forms the axially outermost edge surface of the wing and of the fuze body 50.

Figure 4:
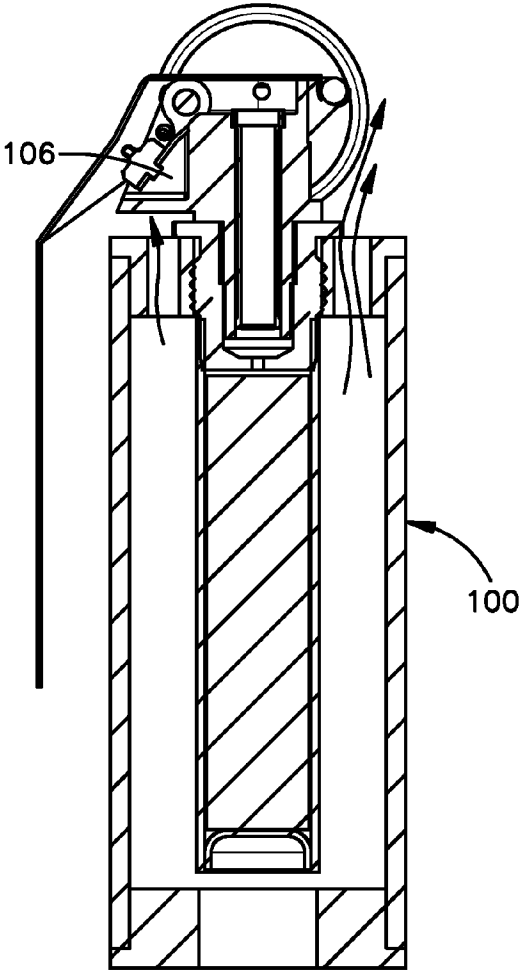
Fig.4 (PRIOR ART)
FIG. 4 is a view similar to FIG. 1 of a prior art stun grenade.
Figure 3:
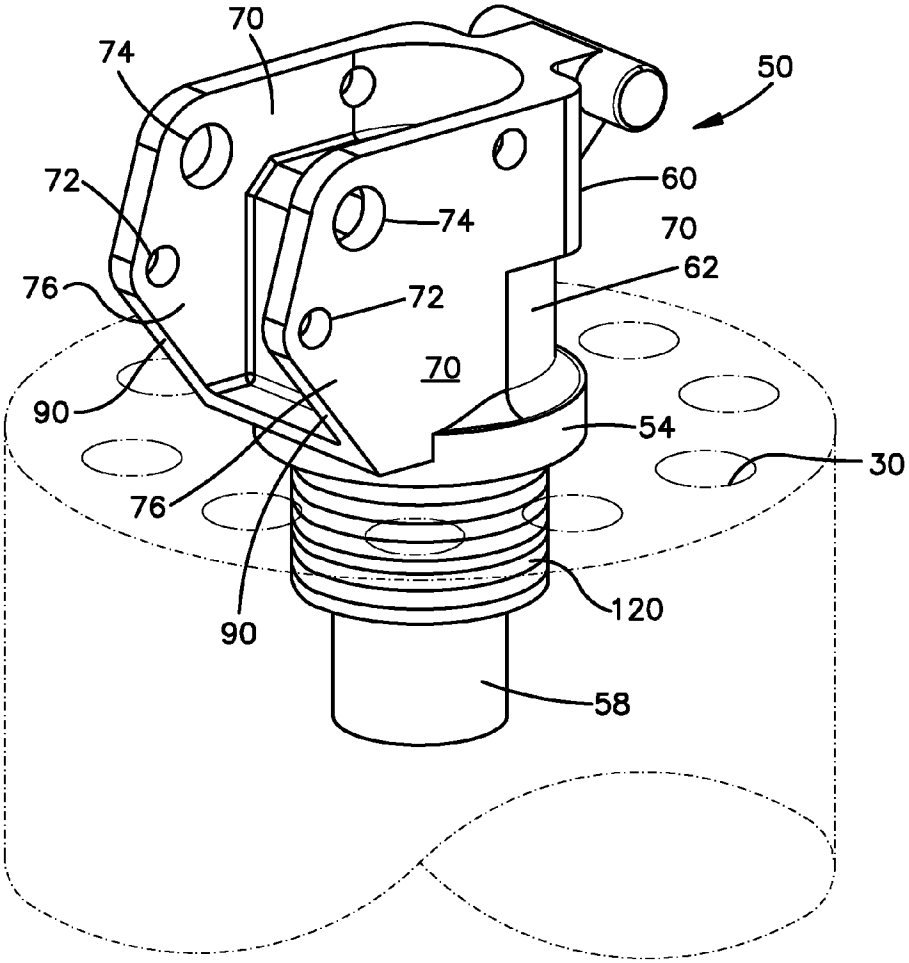
FIG. 3 is a perspective view of a fuze body that forms part of the fuze assembly.
Figure 6:
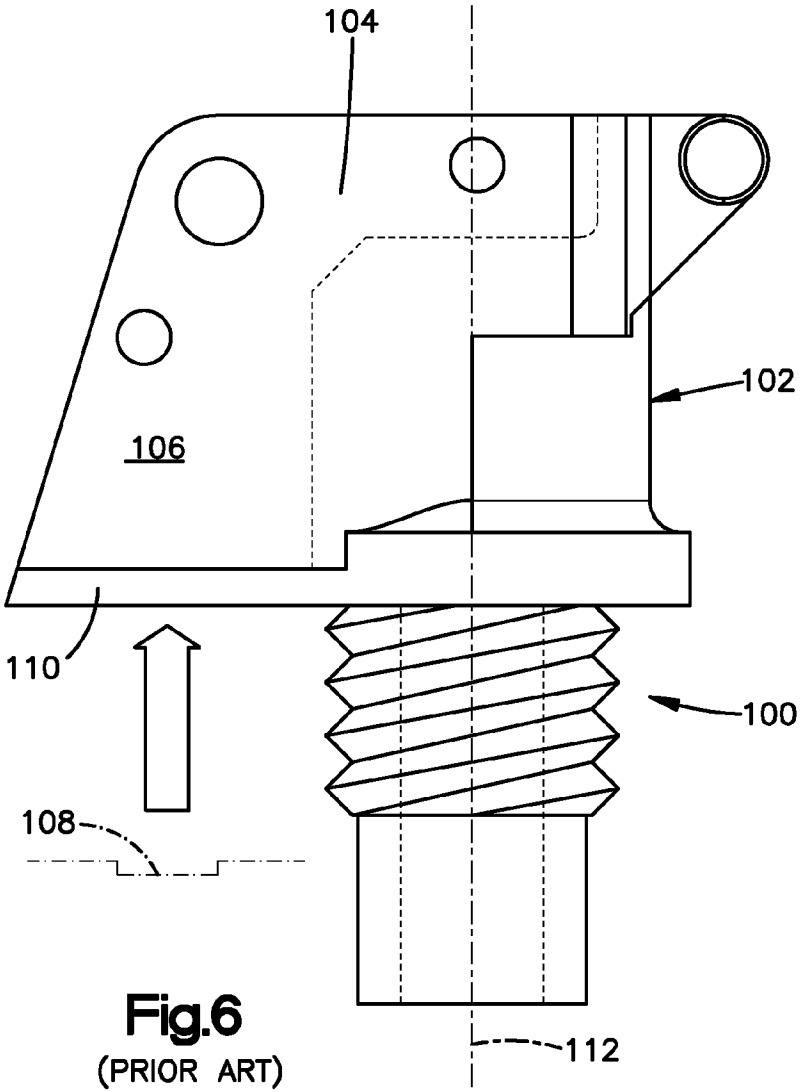
Fig.6 (PRIOR ART)
FIG. 6 is a view similar to FIG. 5 of the fuze body of the prior art stun grenade of FIG. 4.

The amount or portion of the wings 70 that is located axially in line with the outlet ports 30 and relatively far from the axis 16 is thus minimized. Instead, the wings 70 include only the minimum amount of material needed to provide support for the lever 52 and the pin 54, via the openings 74 and 72, respectively. As can be seen from FIG. 5, the wings 70 are free of surface portions that are directly in the flow path 80 and that extend at an angle of more than about 50 degrees, or preferably more than about 40 degrees, to the first direction 82. In addition, the surfaces impinged upon by the gas flowing from the outlet ports 30, because they are angled upward from the flange, are farther away from the outlet ports than in the prior art design (FIGS. 4 and 6). The amount of wing material that is relative relatively far from the axis 16 is minimized. As a result, force exerted on the wings 70 by the gas flowing from the outlet ports 30 is minimized, thus minimizing the possibility of separation or fragmentation of the fuze body 50. The function of the lever 52 and pin 54 are retained.

In contrast, FIGS. 4 and 6 illustrate a prior art device 100 that includes a fuze body 102 having wings 104 with a large portion 106 disposed directly over the outlet ports 108 of the device. The wings 104 have a first edge surface 110 that extends radially outward, in a direction perpendicular to the axis 112. The wings 104 of the prior art device 100 are thus subject to a substantially larger amount of force from the gases flowing from the outlet ports 108.

In accordance with another feature of the invention, the wall thickness of the mounting post 58 is increased as compared to the wall thickness in the prior art fuze body. The same inner diameter is maintained, to accommodate the fuze, resulting in a larger outer diameter for the mounting post. For example, in one fuze body 50 that is an embodiment of the invention, a nominal mounting post wall thickness of 0.225 inches is provided, as compared to a nominal wall thickness of 0.116 inches in the prior art device. This thickened cross-section provides a stronger connection with the collar 32, and means that the fuze body 50 is less likely to bend or separate the fuze head 60, at the location of the flange 54, in response to forces impinging on the wings 70 upon gas generating material activation.

In accordance with another feature of the invention, the fuze body mounting post 58 is provided with a finer thread convolution 120 (FIG. 5) as compared to the thread convolution used in the prior art fuze body. For example, in one fuze body 50 that is an embodiment of the invention, a 9/16-12 thread is used, as compared to the coarser thread that is used in the prior art device. This results in the fuze body mounting post 58 retaining a greater amount of material when the thread is cut, providing a stronger connection with the collar 32, to again minimize the possibility of the fuze body 50 bending or breaking in response to forces impinging on it upon gas generating material activation. In addition, the thread roots on the fuze mounting post 58 are filleted to reduce stress concentration on the threads.

Having described the invention, we claim:

1. A stun grenade comprising:

a housing having a chamber centered on an axis and containing an activatable gas generating material;

the housing having an array of outlet ports on an upper end wall for directing gas out of the chamber, upon activation of the gas generating material, along a gas flow path that extends in a first direction generally parallel to the axis;

a fuze assembly for activating the gas generating material, secured to the upper end wall of the housing;

the fuze assembly including a fuze body having an externally threaded, cylindrical mounting post threaded into the upper end wall of the housing inward of the array of outlet ports to secure the fuze to the housing, the mounting post being hollow for receiving therethrough a fuze;

the fuze body having a lever support portion located axially and radially outward of the post and projecting over the outlet port; and the mounting post being configured to minimize the possibility of separation or fragmentation upon activation of the gas generating material, including the mounting post having a first fine pitch thread convolution that is threadedly engaged with a second fine pitch thread convolution on the housing to secure the fuze body to the housing, the first fine pitch thread convolution having a filleted root diameter;

and further including the hollow cylindrical mounting post having a radial cross sectional wall thickness that is selected to be as large as possible within the constraints of the dimensions of the fuze assembly and of the upper end wall of the housing.

2. A stun grenade as set forth in claim 1 wherein the housing has an outer diameter in the range of from about 1.5 inches to about 1.75 inches, and the mounting post wall has a nominal thickness of about 0.225 inches.

3. A stun grenade as set forth in claim 2 wherein the mounting post wall has an external thread pitch of 5/8-18.

4. A stun grenade as set forth in claim 1 herein the mounting post wall has an external thread pitch of 5/8-18.

* * * * *